US006105221A

United States Patent [19]

Cox

[11] Patent Number: 6,105,221

[45] Date of Patent: Aug. 22, 2000

[54] CASKET TOP INTERIOR ASSEMBLY HAVING ROLL CLAMP

[75] Inventor: Gary L. Cox, Richmond, Ind.

[73] Assignee: Vandor Corporation, Richmond, Ind.

[21] Appl. No.: 09/141,611

[22] Filed: Aug. 28, 1998

[51] Int. Cl.[7] ..... A61G 17/00

[52] U.S. Cl. ..... 27/19; 27/14

[58] Field of Search ..... 27/19, 14, 2; D99/10

[56] References Cited

U.S. PATENT DOCUMENTS

| | | | |
|---|---|---|---|
| 1,268,091 | 6/1918 | Burkhardt . | |
| 2,181,504 | 11/1939 | Bowler, Jr. | 27/19 |
| 2,637,137 | 5/1953 | Flynn | 27/19 |
| 2,718,687 | 9/1955 | Woltering et al. . | |
| 2,947,059 | 8/1960 | Hillenbrand | 27/19 |
| 2,964,824 | 12/1960 | Hillenbrand . | |
| 3,162,923 | 12/1964 | Kaeser . | |
| 3,228,085 | 1/1966 | Nelson . | |
| 3,316,608 | 5/1967 | Ross | 27/19 |
| 3,487,513 | 1/1970 | Herring et al. | 27/19 |
| 4,003,109 | 1/1977 | Matichak . | |
| 4,357,741 | 11/1982 | Winburn et al. . | |
| 4,457,054 | 7/1984 | Craft et al. . | |
| 4,506,419 | 3/1985 | Mitomi | 411/508 X |
| 4,639,985 | 2/1987 | Craft . | |
| 4,657,608 | 4/1987 | Schebler et al. . | |
| 4,868,957 | 9/1989 | Rojdev . | |
| 5,495,648 | 3/1996 | Rojdev et al. . | |
| 5,634,247 | 6/1997 | Bowling . | |
| 5,636,419 | 6/1997 | Foye . | |
| 5,675,877 | 10/1997 | Lewis . | |

*Primary Examiner*—Terry Lee Melius
*Assistant Examiner*—William L. Miller
*Attorney, Agent, or Firm*—Maginot, Addison & Moore

[57] ABSTRACT

A casket top interior assembly includes at least one roll and a roll clamp. The casket top interior assembly is used in connection with a casket lid, the casket lid being generally concave and constructed of a rigid material. The at least one roll has a first elongated edge and a second elongated edge, the first elongated edge secured to the casket lid proximate a periphery of the casket lid, the second elongated edge secured to the casket lid by the roll clamp. To this end, the roll clamp includes an anchor surface and a stop member extending angularly from the anchor surface. The anchor surface is directly secured to the casket lid. The stop member engages the at least one roll proximate the second elongated edge in a trap fit, said trap fit in part securing the roll to the casket lid.

19 Claims, 5 Drawing Sheets

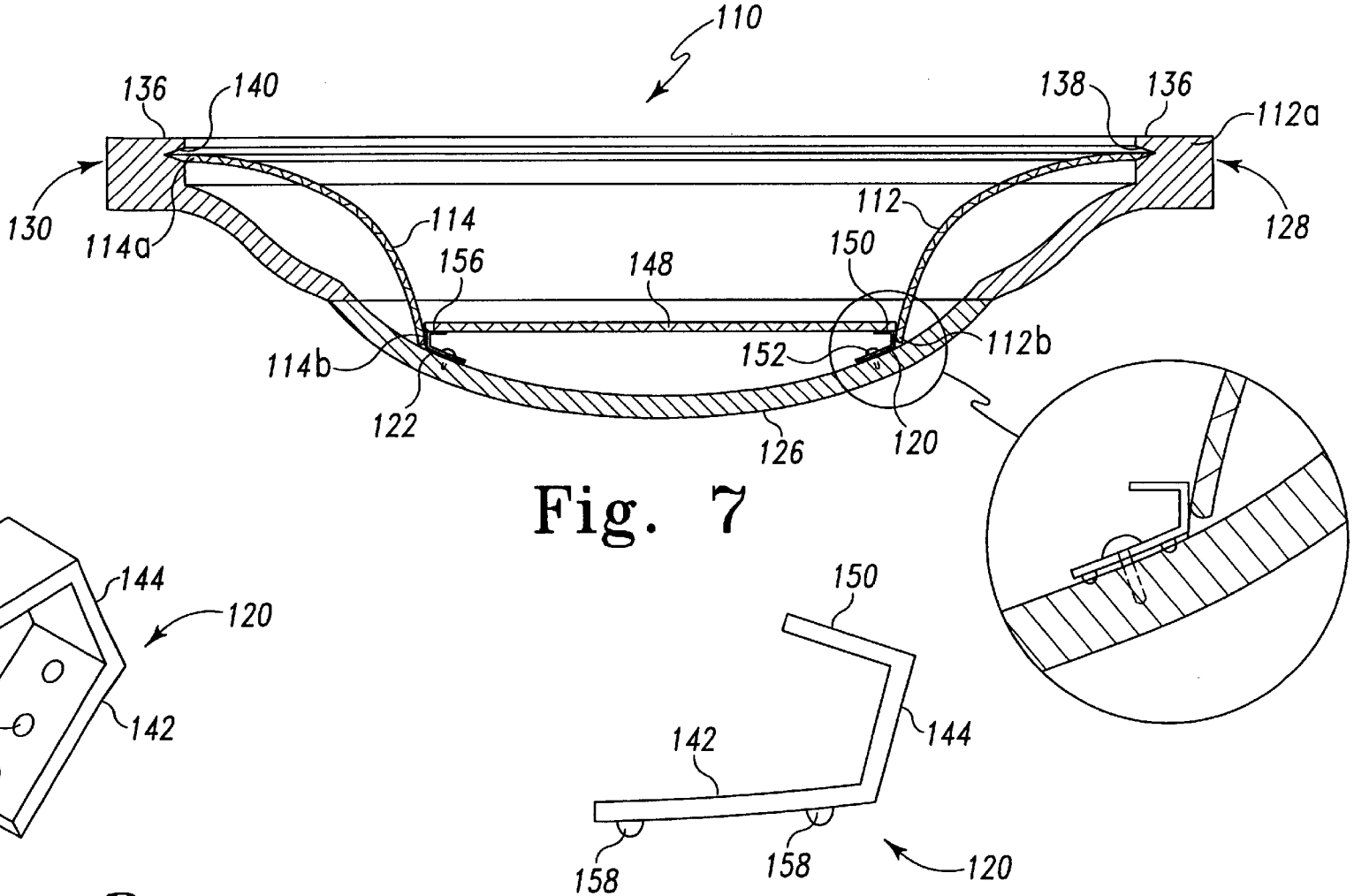
Fig. 7
Fig. 9
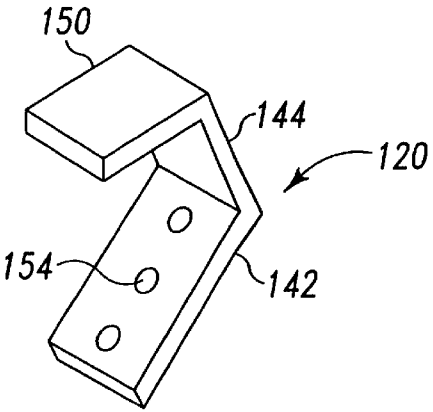
Fig. 8

CASKET TOP INTERIOR ASSEMBLY HAVING ROLL CLAMP

FIELD OF THE INVENTION

The present invention relates generally to caskets, and more particularly, to caskets having casket top interior assemblies.

BACKGROUND OF THE INVENTION

Burial and/or cremation caskets often include a decorative lid underside, or a casket top interior, for purposes of viewing. In particular, during the viewing period, the casket lid is often opened to permit viewing of the deceased. The lid may fully open, or partially open over the top portion of the body. While open, the casket top interior is prominently displayed. It is thus desirable for the casket top interior, or at least the portion that is visible during the viewing, to be aesthetically pleasing.

To this end, the casket industry has widely employed certain decorative mechanisms in casket top interior design. One common casket top interior design includes rolls and a center panel. Rolls are shaped design features that extend inward from each edge of the casket top to form a picture frame effect. The center panel is disposed within the casket top such that the center panel is substantially bordered by the rolls. Both the center panel and rolls are typically cloth covered and hide the otherwise functional and non-aesthetic underside of the metal or wood casket.

In the past, the center panel and rolls were often assembled prior to insertion into the casket top to form a singular casket dish assembly. To this end, the rolls and center panel were typically affixed to each other via stapling or adhesive. The assembly was then affixed to the casket top via staples or other means. U.S. Pat. No. 4,639,985 to Craft shows an exemplary method of affixing a casket dish assembly to the casket top. The Craft patent shows a channel member that is fitted to the periphery of the casket top and includes a channel for receiving edge features of the casket dish assembly. The channel member traps the edges of the dish assembly in the casket top.

One drawback to the dish assembly shown in the Craft patent and other singular dish assemblies is that they do not permit post-manufacturing replacement of the center panel. In particular, it is often desirable to allow post-manufacturing installation of the center panel, preferably at the premises of casket retailers. Specifically, because of the prominent nature of the casket top interior during the viewing, center panels often have custom-selected ornamental designs. The center panel may include religious symbols, poetry, or other personalized material deemed appropriate for the deceased. The ability to install the center panel by the casket retailer or other lay person allows for the consumer to match a select center panel design with a select casket without requiring the retailer to stock all possible combinations. The completed dish assembly such as the one shown in the Craft patent does not allow for easy replacement of the center panel.

One design that allows for post-manufacturing replacement of the center panel is shown in U.S. Pat. No. 5,675,877 to Lewis. The Lewis patent shows a dish assembly that includes rolls, a rectangular cap panel, and a removable center panel. The rolls and the rectangular cap panel are assembled into dish structure in a manner similar to that shown in the Craft patent. However, the rectangular cap panel includes VELCRO® fasteners for receiving corresponding fasteners affixed to the removable center panel.

The rectangular cap panel and rolls are then presumably affixed to the casket top in a manner generally similar to that described in the Craft patent. The removable center panel, which may include decorative markings, may then be fastened onto the rectangular cap panel by simply lining up the fasteners on the removable center panel with those on the cap panel.

One drawback of the device described by the Lewis patent is that it requires additional parts, including a second panel and associated fasteners. Such additional parts undesirably increase both material cost and manufacturing complexity.

A need, therefore, exists for a casket top interior assembly that allows for removable decorative center panels without increasing the part count and manufacturing complexity over the dish assemblies with non-removable decorative center panels.

SUMMARY OF THE INVENTION

The present invention fulfills the above need, as well as others, by providing a casket top interior assembly that includes roll clamps that assist in securing the rolls to the casket top. Preferably, the roll clamps cooperate with casket lid features to trap fit the rolls within the casket top. The use of roll clamps eliminates the need for a second panel member, and in particular, one that is permanently affixed to the rolls to form an assembly that is secured to the casket top. The roll clamps instead allow the rolls to be secured to the casket top individually, and not as an entire dish assembly. Because the rolls are secured to the casket top independent of the center panel, the center panel may be readily installed in a post-manufacturing environment.

In one embodiment of the present invention, a casket top interior assembly includes at least one roll and a roll clamp. The casket top interior assembly is used in connection with a casket lid, the casket lid being generally concave and constructed of a rigid material. The at least one roll has a first elongated edge and a second elongated edge, the first elongated edge secured to the casket lid proximate a periphery of the casket lid, the second elongated edge secured to the casket lid by the roll clamp. To this end, the roll clamp includes an anchor surface and a stop member extending angularly from the anchor surface. The anchor surface is directly secured to the casket lid. The stop member engages the at least one roll proximate the second elongated edge in a trap fit, said trap fit at least in part securing the roll to the casket lid.

The above described casket top interior assembly may readily receive a center panel that is installed in the post-manufacturing environment by a casket retailer or other person and then secured to the casket lid by any suitable means.

The above described features and advantages, as well as others, will become more readily apparent to those of ordinary skill in the art by reference to the following detailed description and accompanying drawings.

BRIEF DESCRIPTION OF THE DRAWINGS

FIG. 7 shows a side sectional view of a second embodiment of a casket top interior assembly according to the present invention;

FIG. 8 shows a perspective view of an exemplary second embodiment of a roll clamp for use in the second embodiment of the casket top interior assembly of FIG. 7; and FIG. 9 shows a side view of the roll clamp of FIG. 8.

DETAILED DESCRIPTION

Figure 1:
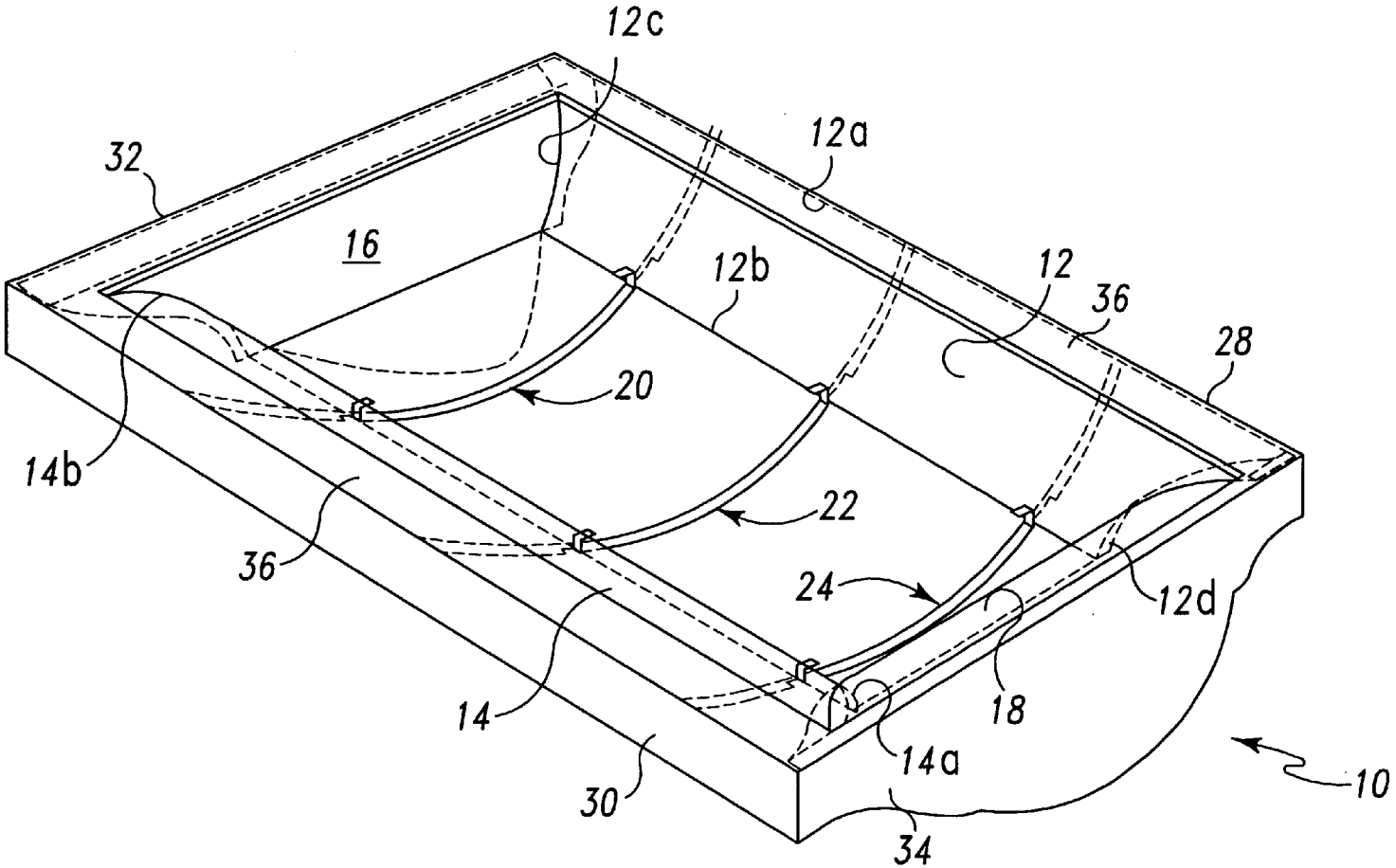
FIG. 1 shows a perspective view of a first embodiment of a casket top interior assembly according to the present invention employed in a casket lid.
Figures 2, 3:
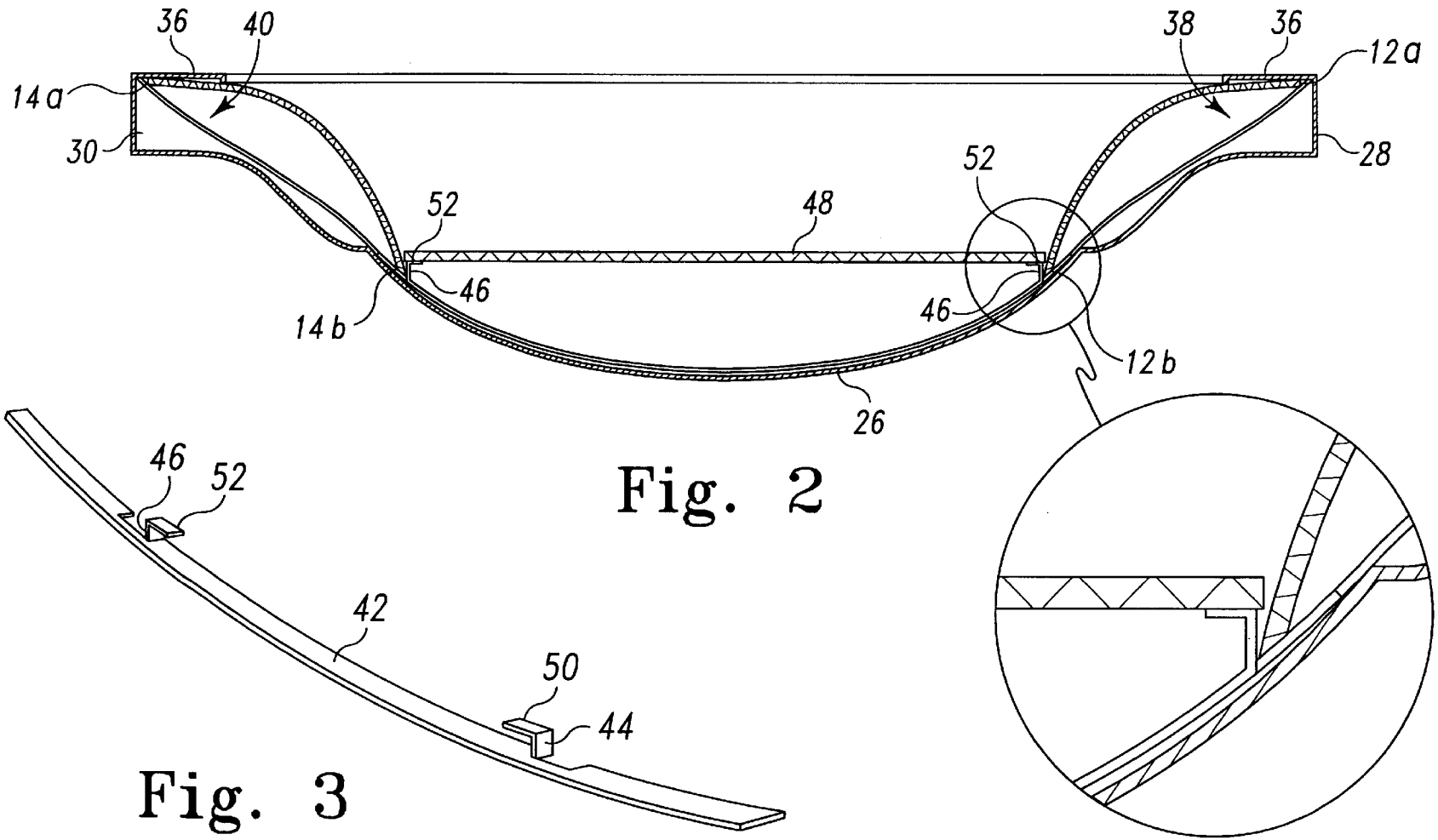
FIG. 2 shows a side sectional view of the first embodiment of a casket top interior assembly of FIG. 1, and further includes a replaceable center panel.
FIG. 3 shows an exemplary first embodiment of a roll clamp for use in the first embodiment of the casket top interior assembly of FIG. 1.

Reference is now made to FIGS. 1 and 2 which show a first embodiment of a casket top interior assembly according to the present invention. In particular, FIG. 1 shows a perspective view of a first embodiment of a casket top interior assembly according to the present invention employed in a casket lid 10, and FIG. 2 shows a side sectional view of the casket top interior assembly and casket lid 10 of FIG. 1. It is noted that FIG. 2 also shows a replaceable center panel 48 which has been omitted from FIG. 1 for clarity of exposition. It will also be noted that hidden lines are shown as broken lines to provide a clear depiction of the different components and how they interrelate. In general, the exemplary casket top interior assembly of FIGS. 1 and 2 includes a first side roll 12, a second side roll 14, a first end roll 16, a second end roll 18, and first, second, and third roll clamps 20, 22 and 24, respectively.

The casket lid 10 shown in FIGS. 1 and 2 may suitably be constructed of metal, such as steel or bronze, and has a structure that is representative of known casket lid designs. In general, the casket lid 10 is defined by a sculpted and generally concave body portion 26 bordered on each side by side walls 28 and 30 and on each end by end walls 32 and 34. The side walls 28 and 30 and the end walls 32 and 34 extend vertically from the body portion 26. Extending horizontally inward from each of the side walls 28 and 30 and from each of the end walls 32 and 34 are overhang portions shown generally as the overhangs 36. The overhangs 36 cooperate with the side walls 28 and 30 to form concave features 38 and 40, respectively. The overhangs 36 also cooperate with the end walls 32 and 34 to form similar L-shaped concave features, not shown.

It will be noted that the present invention is not limited in any way to use within a casket having the precise features of the casket lid 10. The first embodiment of the casket top interior assembly of the present invention as shown, however, is designed to cooperate with casket lids having an overhang such as any of the overhangs 36, which are well known in the art. Moreover, the present invention is in no way limited to metal caskets, but may readily be employed in a casket constructed of any rigid material such as wood, plastic, fiberglass, paper, and other composite materials.

Referring again to the casket top interior assembly, the first side roll 12 has a first elongated edge 12*a* and a substantially parallel second elongated edge 12*b*. The first side roll 12 further includes first and second end edges 12*c* and 12*d*, respectively, which together with the first and second elongated edges 12*a* and 12*b*, respectively, define the periphery of the first side roll 12. The first side roll 12 has a formed or sculpted shape that is generally uniform in cross-section.

In the exemplary embodiment described herein, the first side roll 12 has an arcuate cross-section. Each of the first and second end edges 12*c* and 12*d* has a shape generally corresponding to the cross-section of the first side roll 12. The first side roll 12 may suitably be constructed of molded plastic, plastic sheet, chip-type paper board, corrugated paper material, or composite material. In the exemplary embodiment described herein, the side roll is a form of roll known in the art as a hard roll. Preferably, the hard roll is a molded product composed of clay-coated newsback chip with a single face corrugated box board laminated to the back thereof. The use of such a hard roll provides sufficient spring-like resiliency to facilitate a strong friction fit.

The first elongated edge 12*a* is secured to the casket lid 10 proximate a periphery of the casket lid 10. Specifically, in the embodiment described herein, the first elongated edge 12*a*is trapped within the first concave feature 38. In particular, the first elongated edge 12*a* is prevented from vertical movement upward by the overhang 36, and from vertical movement downward by cooperation of the first side wall 28 and the structure of the first side roll 12 itself. The second elongated edge 12*b* is secured to the casket lid 10 by at least the first roll clamp 20, and preferably also by the second roll clamp 22 and the third roll clamp 24.

The second side roll 14 preferably has a similar structure as the first side roll 12, and includes analogous first and second elongated edges 14*a* and 14*b*, respectively, and first and second end edges 14*c* and 14*d*, respectively. The first elongated edge 14*a* of the second side roll 14 is secured to the casket lid 10 proximate the periphery of the casket lid 10, and preferably within the second concave feature 40. The second elongated edge 14*b* of the second side roll 14 is secured to the casket lid 10 by at least one roll clamp. In the exemplary embodiment described herein, second elongated edge 14*b* of the second side roll 14 is secured to the casket lid 10 by roll clamps 20, 22 and 24.

FIG. 3 shows an exemplary first embodiment of the roll clamp 20 of the casket top interior assembly of FIGS. 1 and 2. According to the present invention, the first roll clamp 20 includes an anchor portion 42, a first stop member 44, and a second stop member 46. The first and second stop members 44 and 46, respectively, extend angularly from the anchor portion 42.

The anchor portion 42 is directly secured to the casket lid 10. In particular, the anchor portion 42 defines an elongated flat surface preferably constructed of flexible material. The anchor portion 42 is inserted into the casket lid 10 such that it extends from the first side wall 28 to the second side wall 30. Moreover, the anchor portion 42 is positioned to substantially abut the sculped underside of the body portion 26 of the casket lid 10. The length of the anchor portion 42 is thus defined such that the anchor portion 42 extends from the intersection of the first side wall 28 and the overhang 36 to the intersection of the second side wall 30 and the overhang 36. Once properly inserted, the flexible anchor portion 42 is trap fit or interference fit by the first side wall 28, the second side wall 30 and the overhang 36.

The first stop member 44 and second stop member 46 in the exemplary embodiment described herein are integrally formed with the anchor portion 42. To this end, the roll clamp 20 may suitably be constructed of a band of steel or other similar metal. Such a roll clamp could be stamped from a flat sheet of metal. The flexible nature of the band of steel would allow for placement in the casket lid 10 as described above. Alternatively, a suitable roll clamp may be constructed out of a plastic material, for example, injectionmolded plastic. Such a roll clamp may be preformed with an adequate arched shape to facilitate placement in the casket lid 10 as described above. Such a roll clamp need not have the same flexibility as one stamped from a flat sheet of material.

In any event, as shown in FIG. 2, the first stop member 44 extends angularly from the anchor portion 42, and hence the casket lid 10, in a predetermined position such that it provides a trap fit for the second elongated edge 12*b* of the first side roll 12. More specifically, the second elongated edge 12*b* is trap fit in the intersection of the anchor portion 42 and the angularly extending first stop member 44. Similarly, the second stop member 46 extends angularly from the anchor portion 42 in a predetermined position such that it provides a trap fit for the second elongated edge 14*b* of the second side roll 14.

In the exemplary embodiment described herein, the second roll clamp 22 and third roll clamp 24 preferably have the same structure as the first clamp 20 (See FIG. 3). The second roll clamp 22 is disposed in a spaced apart relationship with respect to the first roll clamp 20, but is otherwise positioned within the casket lid 10 in a substantially parallel manner. The third roll clamp 24 likewise is disposed in a spaced-apart relationship with respect to both the first roll clamp 20 and the second roll clamp 22, but is otherwise positioned within the casket lid 10 in a substantially parallel manner. The second roll clamp 22 and third roll clamp 24 are advantageously positioned to provide an interference fit for each of the first and second side rolls 12 and 14, respectively, in a manner similar to that described above in connection with the first roll clamp 20.

The trap fit or interference fit provided by the roll clamps 20, 22 and 24 according to the present invention thus at least in part secures the side rolls 12 and 14 to the casket lid 10. The side rolls 12 and 14 may therefore be readily installed without first constructing an entire dish assembly wherein all the rolls and center panel are pre-assembled before installation into the casket lid. As a result, a center panel may readily be inserted and/or removed independent of the rolls.

Moreover, the roll clamps of the present invention provide similar advantages in caskets that do not include an overhang feature such as the overhang 36. In particular, even if other means are employed to connect the first elongated edge of the side rolls near the casket lid periphery, the roll clamps according to the present invention may still be used to secure the second elongated edge of the rolls to the interior of the casket lid.

Figure 4:
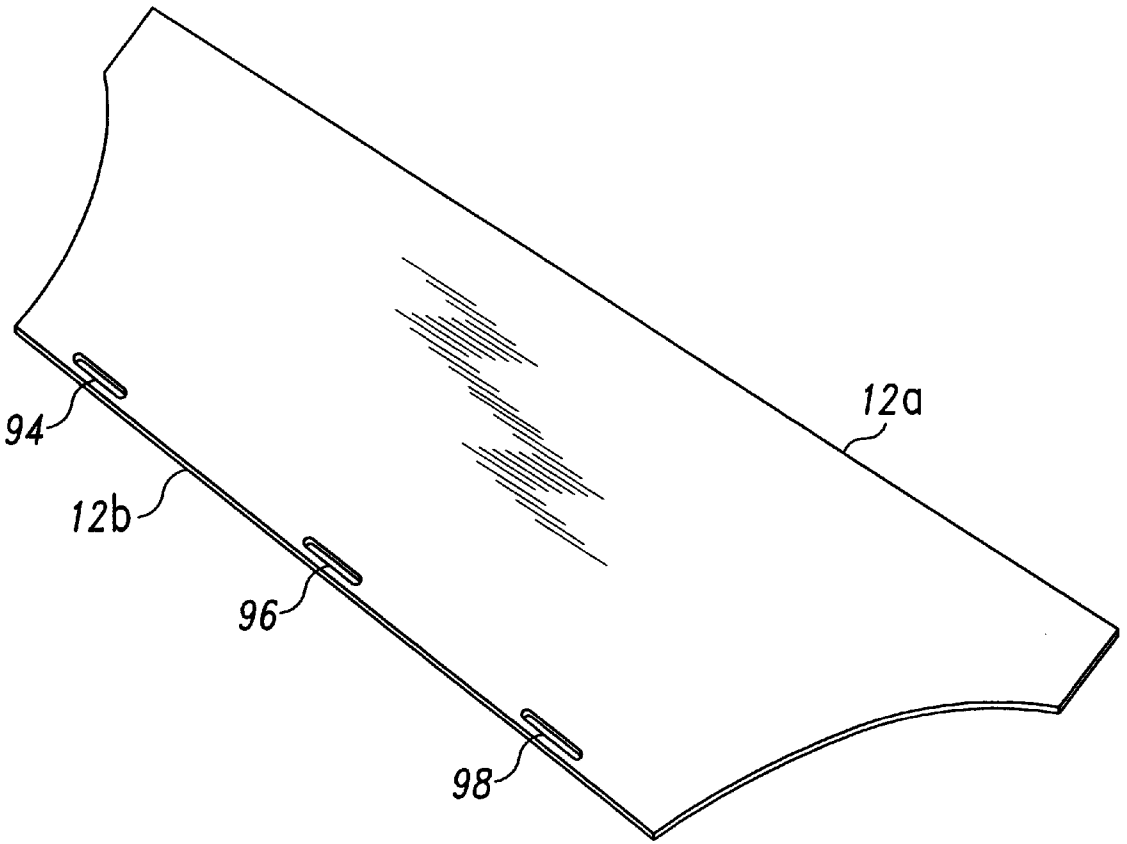
FIG. 4 shows a perspective view of an alternative embodiment of a side roll for use in the casket top interior assembly of FIG. 1.
Figure 5:
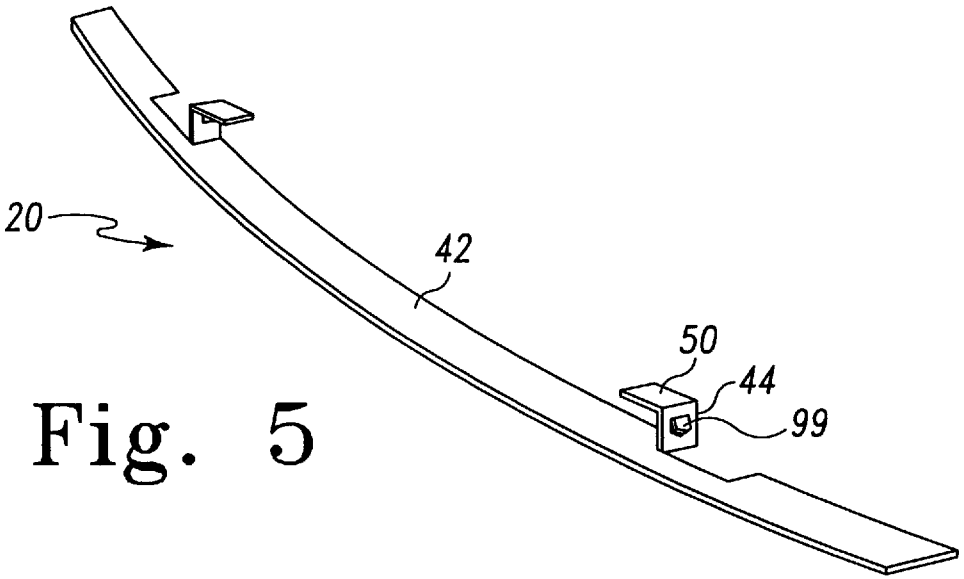
FIG. 5 shows a perspective view of an alternative embodiment of a roll clamp for use in the casket top interior assembly of FIG. 1.
Figure 6:
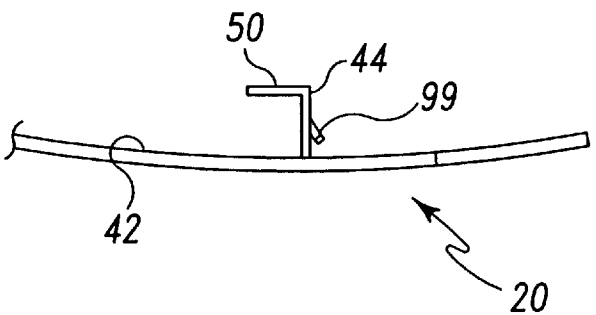
FIG. 6 shows a side view of the roll clamp of FIG. 5.

It will be noted that in some cases, additional retention force may be required to hold the side rolls in place. To this end, a latching arrangement may be provided between the side rolls and roll clamps. FIGS. 4, 5 and 6 illustrate such a latching arrangement which may readily be incorporated into the casket top interior assembly of FIGS. 1 and 2. In particular, FIG. 4 shows an alternative embodiment of the side roll 12 which may be used as an alternative to the first side roll 12 in FIGS. 1 and 2. FIGS. 5 and 6 show an alternative embodiment of a roll clamp 20 which may be used as an alternative to the first roll clamps 20 of FIGS. 1, 2 and 3.

Referring now to FIGS. 4, 5 and 6, the alternative embodiment of the first side roll 12 has essentially the same construction as the first embodiment of first side roll 12. As a result, the same reference numerals are employed for analogous features in both embodiments. The first side roll 12 of FIG. 4 also includes elongated channel notches 94, 96 and 98 disposed proximate the second elongated edge 12*b* of the first side roll 12. The elongated channel notch 94 is disposed at a position along the second elongated edge 12*b* in which the edge 12*b* engages the first roll clamp 20. The elongated channel notch 96 is disposed at a position along the second elongated edge 12*b* in which the edge 12*b* engages the second roll clamp 22. Finally, the elongated channel notch 98 is disposed at a position along the second elongated edge 12*b* in which the edge 12*b* engages the third roll clamp 20.

The alternative embodiment of the roll clamp 20 analogously has essentially the same construction as the first embodiment of the roll clamp 20 of FIG. 3. As a result, the same reference numerals are employed for analogous features in both embodiments. The roll clamp 20 of FIGS. 5 and 6, however, further includes a barb 99 the extends outward from the first stop member 44. The barb 99 is advantageously positioned to be received by the elongated channel notch 94 when the roll clamp 20 and the first side roll 12 are installed within the casket lid.

The engagement of the barb 99 and the elongated channel notch 94 form a latching arrangement that further inhibits and preferably prevents movement of the first side roll 12 away from the casket lid after assembly. Similar barbs on the other roll clamps engage the elongated channel notches 96 and 98 to form further latching arrangements for added integrity. Such latching arrangements may be necessary if the rolls 12 and 14 are "soft rolls" rather than "hard rolls". Soft rolls, as are known in the art, do not have the same degree of resiliency as hard rolls. As a result, the additional retention force provided by the latching arrangement illustrated in FIGS. 4, 5 and 6 may be necessary to satisfactorily inhibit movement of the rolls 12 and 14 out of position during transport or use of the casket.

Alternatively, the first embodiment of the roll clamp 20 described above in connection with FIGS. 1 and 2 may be used in conjunction with fasteners, such as staples (in a wooden casket), to secure the side rolls 12 and 14 in the interior of the casket lid. In such a case, the roll clamp 20 would still provide mechanical retention force to the side rolls 12 and 14, which at least would partially secure the side rolls 12 and 14 to the casket lid 10. However, the fasteners would provide a degree of reinforcement thereto. In such a case, the roll clamps according to the present invention serve to reduce substantially the number of mechanical fasteners that would otherwise be required to secure the side roll to the casket lid.

Moreover, the roll clamps 20, 22 and 24 also provide the advantage of operating as a registration mechanism that positions the rolls 12 and 14 properly within the casket lid 10. In particular, because the stop members 44 and 46 are disposed at a predetermined location on the anchor portion 42 and thus at a predetermined location on the casket lid 10, the stop members 44 and 46 urge the rolls 12 and 14 into the proper predetermined position. Even if the rolls 12 and 14 are then permanently secured to the casket lid 10 by fasteners or other means, the stop members 44 and 46 at least temporarily engage the second elongated edges 12*b* and 14*b*, respectively, so that the rolls 12 and 14 are properly positioned when the permanent fastening operation is carried out.

Thus, the roll clamps of the first embodiment of the present invention provide a number of advantages in the assembly of rolls within a casket lid. Specifically, the roll clamps of the present invention secure at least in part, either temporarily or permanently, the rolls in a predetermined position within the casket lid.

Referring again to FIGS. 1 and 2, each of the end rolls 16 and 18 of the casket top interior assembly preferably has a structure similar to side rolls 12 and 14 and is arranged within the casket top interior assembly to cooperate with the side rolls 12 and 14 to form a substantially rectangular housing. In particular, for example, the first end roll 16 includes two elongated edges defining a length thereof and two end edges defining a width thereof and is secured to the casket lid 10 by any suitable means. In the exemplary embodiment described herein, the end roll 16, for example, is secured through a trap fit formed by the overhang 36, the end wall 32, the first end edge 12*c* of the first side roll 12, and the first end edge 14*c* of the second side roll 14. In particular, one elongated edge of the first end roll 16 is trap fit between the overhang 36 and the end wall 32, and portions of the front surface of the first end roll 16 engage the end edges 12*c* and 14*c*.

The second end roll 18 has a substantially similar structure and is secured to the casket lid 10 in a substantially similar manner. In particular, the second end roll 18 includes a first elongate edge that is trap fit between the overhang 36 and the end wall 34 and a front surface that engages the second end edge 12*d* of the first side roll 12 and the second end edge 14*d* of the second side roll 14.

In accordance with the above mentioned advantages of permitting the rolls and the center panel to be installed individually and not as a pre-assembled unit, the present invention facilitates the use of a post-manufacturing replaceable center panel. FIG. 2 shows the first embodiment of the casket top interior assembly with a replaceable or "pop-in" center panel 48 installed within the casket lid 10. The center panel 48 may suitably be a substantially planar, rectangular section of corrugated paper covered by fabric such as linen or crepe. The fabric covering may optionally include decorative indicia, not shown. The center panel 48 is disposed adjacent to the side rolls 12 and 14 and preferably also adjacent to the end rolls 16 and 18, not shown in FIG. 2.

It is noted that because the roll clamps 20, 22 and 24 are interposed between the center panel 48 and the casket lid 10, the center panel 48 also serves the purpose of concealing at least a portion of the roll clamps 20, 22 and 24 from view of an observer. In particular, the center panel 48 and the side rolls 12 and 14 cooperatively conceal the roll clamps 20, 22 and 24 entirely from the observer.

In accordance with the first embodiment of the casket top interior assembly shown in FIG. 1, the roll clamps 20, 22 and 24 each further comprise center panel engagement surfaces that angularly extend from their respective stop members. In particular, referring to FIGS. 2 and 3, the first roll clamp 20, by way of example, includes a first center panel engagement surface 50 extending angularly from the first stop member 44, and a second center panel engagement surface 52 extending angularly from the second stop member 46. As shown in FIG. 2, the center panel engagement surfaces 50 and 52 engage and support the center panel 48 at a predetermined height with respect to the body portion 26.

A method of assembling the first embodiment of the casket top interior assembly shown in FIGS. 1, 2 and 3 includes a first step of installing the roll clamps 20, 22 and 24 in the casket lid 10 such that the anchor portion of each roll clamp 20, 22 and 24 extends from the first side wall 28 of the casket lid 10 to the second side wall 30 of the casket lid 10. Each of the roll clamps 20, 22 and 24, as a result, is trap fit or interference fit within the casket lid 10.

The end rolls 16 and 18 may then be inserted into the casket top 10. To this end, the first end roll 16 is inserted such that one elongated edge thereof engages the overhang 36 and the first end wall 32 and the other elongated edge is loosely supported by a portion of the body portion 26. Similarly, the second end roll 18 is inserted such that one elongated edge thereof engages the overhang 36 of second end wall 34 and the other elongated edge is loosely supported by a portion of the body portion 26.

The first side roll 12 is then installed into the casket lid 10. To this end, the first elongated edge 12*a* is installed into the first concave feature 38 and advanced therein until the first elongated edge 12*a* contacts the first side wall 28. Contemporaneously, the second elongated edge 12*b* is inserted into the corner defined by the first stop member 44 and the adjacent portion of the anchor surface 42. To this end, the first side roll 12 may be slightly elastically deformed to fit between the first concave feature 38 and the first stop member 44. It is noted that the second elongated edge 12*b* is also contemporaneously inserted into analogous corners of the other roll clamps 22 and 24. In any event, the elastic forces tend to urge the second elongated edge 12*b* outward, or into the first stop member 44. Such forces combined with the trap fit or interference fit provided by the first concave feature 38 and the first stop member 44 help secure the first roll within the casket lid 10.

When the first side roll 12 is installed, it further engages the first end roll 16 and the second end roll 18 to assist in securing the end rolls 16 and 18 in place. In particular, the end edge 12*c* engages the front surface of the first end roll 16 and the end edge 12*d* engages the front surface of the second end roll 18.

The second side roll 14 is then installed into the casket lid 10 in a similar manner. In particular, the first elongated edge 14*a* is inserted into the second concave feature 40 until it engages the second side wall 30. The second elongated edge 14*b* is also inserted to the intersection of the second stop member 46 and the adjoining section of the anchor portion 44, as well as into intersections defined by the corresponding stop members and anchor portions of the roll clamps 22 and 24.

When the second side roll 14 is installed, it further engages the first end roll 16 and the second end roll 18 to cooperate with the first side roll 12 in securing the end rolls 16 and 18 in place. In particular, the end edge 14*c* engages the front surface of the first end roll 16 and the end edge 14*d* engages the front surface of the second end roll 18. As a result, the end roll 16 is secured in place by the trap or interference fit between the overhang 36 and the end edges 12*c* and 14*c*. Likewise the end roll 18 is secured in place by the trap or interference fit between the overhang 36 and the end edges 12*d* and 14*d*.

The center panel 48 is then disposed on the respective center panel engagement surfaces of the roll clamps 20, 22 and 24. The center panel 48 is then secured in such position either through mechanical coupling (not shown) to one or more of the roll clamps 20, 22 and 24, or through a trap fit or friction fit with the side rolls 12 and 14 and the end rolls 16 and 18. In the case of a trap fit or friction fit, the center panel 48 should have dimension equal to or slightly exceeding the housing formed by the second elongated edges 12*b* and 14*b*, and corresponding edges of the end rolls 16 and 18. Alternatively, the trap fit or friction fit may be provided by either the side rolls 12 and 14 exclusively or the end rolls 16 or 18 exclusively. In yet another alternative, any of the above arrangements for securing the center panel 48 within the casket top interior assembly may be supplemented mechanical fasteners or other types of fastening or securing means, such as glue, staples, or hook and loop fastening material.

FIG. 7 shows a second embodiment of the casket top interior assembly that uses a second embodiment of a roll clamp according to the present invention. The second embodiment of the roll clamp 120 is shown in further detail in FIGS. 8 and 9. The casket top interior assembly shown in FIG. 7 is shown assembled into a wooden casket lid 110 having design features well known in the art.

In particular, the casket lid 110, like the casket lid 10 of FIG. 1, is defined by a sculpted and generally concave body portion 126 bordered on each side by side walls 128 and 130 and on each end by end walls, not shown. The side walls 128 and 130 in the disclosed embodiment are solid lengths of wood and have a rectangular or square cross section. However, the side wall 128 includes a concave feature 138 in the form of a channel that extends the length of the side wall and is open toward the interior of the casket lid 110. The concave feature 138 defines a V-shaped cut-out in the otherwise solid rectangular cross section of the side wall 128. The concave feature 138 also defines an overhang 136 in the side wall 128. Likewise, the side wall 130 includes a similar concave feature 140 that defines a similar V-shaped cut-out in the otherwise rectangular cross section of the side wall 130. The concave feature 140 further defines the overhang 136 in the side wall 130.

It will be noted that the present invention is not limited in any way to use within a casket having the precise features of the casket lid 110. The first embodiment of the casket top interior assembly of the present invention as shown, however, is designed to cooperate with casket lids having an overhang such as the overhang 36, which are well known in the art.

The casket top interior assembly of FIG. 7 includes first and second side rolls 112 and 114, a first end roll 116, a second end roll, not shown, a first roll clamp 120 and a second roll clamp 122. The first side roll 112, the second side roll 114, the first end roll 116, and the second end roll may suitably have essentially the same structure and appearance as the corresponding rolls 12, 14, 16 and 18 of FIG. 1.

Accordingly for example, the first side roll 112 has a first elongated edge 112*a* and a substantially parallel second elongated edge 112*b*. The first elongated edge 112*a* is secured to the casket lid 110 proximate a periphery of the casket lid 110. Specifically, in the embodiment described herein, the first elongated edge 112*a* is trapped within the first concave feature 138. In particular, the first elongated edge 112*a* is prevented from vertical movement upward by the overhang 136, and from vertical movement downward by the underside of the first concave feature 138. The second elongated edge 112*b* is secured to the casket lid 110 by at least the first roll clamp 120, and preferably also by additional roll clamps, not shown, that are similarly constructed and disposed.

The second side roll 114 also has first and second elongated edges 114*a* and 114*b*, respectively. The first elongated edge 114*a* of the second side roll 114 is secured to the casket lid 110 proximate the periphery of the casket lid 110, and preferably within the second concave feature 140. The second elongated edge 114*b*of the second side roll 114 is secured to the casket lid 110 by at least one roll clamp. In the exemplary embodiment described here in connection with FIG. 7, second elongated edge 114*b* of the second side roll 114 is also secured to the casket lid 110 by the second roll clamp 122, and preferably two other similarly constructed and disposed roll clamps.

Referring to FIGS. 8 and 9, the exemplary second embodiment of the roll clamp 120 of the casket top interior assembly includes an anchor portion 142, a stop member 144, and preferably a center panel receiving surface 150. The stop member 144 extends angularly from the anchor portion 142 and is preferably formed integrally therewith.

The anchor portion 142 is directly secured to the casket lid 110 through a fastener 152. The fastener may suitably be a bolt, screw, rivet or other fastening means. In the exemplary embodiment described herein, the anchor portion 142 defines a generally planar surface and includes a fastener receiving aperture 154. The fastener 152 is, by way of example, a screw that is rotatably inserted through the aperture 154 and into the casket lid 110. The anchor portion 142 is advantageously positioned in the casket lid 110 such that the stop member 144 engages the first side roll 112 proximate the second elongated edge 112*b* when the first elongated edge 112*a* is fully inserted into the concave feature 138.

In any event, as shown in FIG. 7, the stop member 144, which extends angularly from the anchor portion 142, and hence the casket lid 110, provides a trap fit for the second elongated edge 112*b* of the first side roll 112. In the present embodiment, the second elongated edge 112*b* is trap fit in the intersection of the casket lid 110 and the angularly extending stop member 144.

The anchor surface 142 also preferably includes one or more detents or barbs 158 in the portion of the anchor surface 142 that abuts the casket lid 110. The detents 158 act as anti-rotation mechanism that engage the casket lid 110 to inhibit rotation of the anchor surface 142 during installation of the fastener 152 and otherwise.

In the exemplary embodiment described herein, the second roll clamp 122 preferably has the same structure as the first roll clamp 120 (See FIGS. 8 and 9). The second roll clamp 122 is disposed, however, to cooperate with the second concave feature 140 to form a trap fit or interference fit for the second side roll 114.

In accordance with the second embodiment of the casket top interior assembly shown in FIG. 7, the roll clamps 120 and 122 each further comprise center panel engagement surfaces that angularly extend from their respective stop members. In particular, referring to FIGS. 7, 8 and 9, the first roll clamp 120, by way of example, includes a center panel engagement surface 150 extending angularly from the stop member 144. The second roll clamp 122 also includes a corresponding center panel engagement surface 156. Preferably, other similar roll clamps, not shown, have similar center panel engagement surfaces. As shown in FIG. 7, the center panel engagement surfaces 150 and 156 engage and support the center panel 148 at a predetermined height with respect to the body portion 126.

Otherwise, the second embodiment of the casket top interior assembly is similar to that described above in connection with FIGS. 1 and 2.

The second embodiment of the roll clamp 120 shown in FIGS. 7, 8 and 9 has advantages in reduced material requirements and weight as compared to the roll clamp 20 of FIGS. 1, 2 and 3. However, as opposed to the roll clamp 20 of FIGS. 1, 2 and 3, the roll clamp 120 must be carefully and precisely located within the casket lid 110. In addition, the roll clamp furthermore requires a fastener, and thus an additional manufacturing step. Those of ordinary skill in the art may readily determine whether their particular requirements favor the reduced material requirements of the second embodiment of the roll clamp or the reduced manufacturing complexity of the first embodiment of the roll clamp.

It will be noted that the above described embodiments are merely exemplary, and that those of ordinary skill in the art may readily devise their own implementations that incorporate the principles of the present invention and fall within the spirit and scope thereof. For example, the use of three or six roll clamps as shown in the embodiment of FIGS. 1 and 7 is given by way of example only. Those of ordinary skill in the art may readily use more or less roll clamps as necessary to achieve the strength/cost balance desirable for their particular application. Moreover, the use of arcuate shaped side rolls (and end rolls) is also given by way of example only, and side rolls having other cross-sectional shapes may readily be incorporated into the casket top interior assembly according to the present invention.

I claim:

1. A method of securing a casket to interior assembly within a casket lid, the casket lid having a periphery, the method comprising:

a) securing a first roll clamp to the casket lid, the roll clamp including an anchor portion, a first angularly extending stop member and a second stop member, such that the anchor portion is directly secured to the casket lid;

b) securing a first elongated edge of a first roll to the casket lid proximate the periphery of the casket lid and securing a first elongated edge of a second roll to the casket lid proximate the periphery;

c) securing a second elongated edge of the first roll to the casket lid such that the first angularly extending stop member engages the first roll proximate the second elongated edge thereof, and securing a second elongated edge of the second roll to the casket lid such that the second stop member engages the second roll proximate the second elongated edge thereof, wherein the second elongated edge of each of the first and second roll is spaced apart from the first elongated edge by a roll surface; and d) after the second elongated edge of the first roll is secured to the casket lid, securing a center panel within the casket lid.

2. The method of claim 1 wherein the casket lid includes an overhang and step b) further comprises securing the first elongated edge of the first roll to the casket lid proximate the periphery of the casket lid using a trap fit formed by the overhang.

3. The method of claim 2 wherein the anchor portion includes an elongated surface, and step a) further comprises forming a trap fit with the overhang and the elongated surface to secure the first roll clamp to the casket lid.

4. The method of claim 1 wherein step c) further comprises securing the second elongated edge to the casket lid using a trap fit formed by the stop member and a portion of the first roll proximate the second elongated edge.

5. The method of claim 1 wherein step a) further comprises securing the anchor portion of the roll clamp to the casket lid using a fastening means.

6. The method of claim 1 wherein step a) further comprises securing a first roll clamp to the casket lid wherein the anchor portion and the first stop member are integrally formed.

7. The method of claim 1 wherein step d) further comprises securing the center panel within the casket lid such that the at least a portion of the first roll clamp is interposed between the casket lid and the center panel.

8. The method of claim 1 wherein step d) further comprises securing the center panel within the casket lid such that the center panel engages the roll clamp.

9. The method of claim 1 wherein step d) further comprises securing the center panel within the casket lid such that the center panel engages a center panel engagement surface that angularly extends from the stop member of the first roll clamp.

10. The method of claim 1 wherein step c) further comprises securing the second elongated edge of the first roll to the casket lid in part using a fastening means.

11. A method of securing a casket to interior assembly within a casket lid, the casket lid having a periphery, the method comprising:

a) securing a first roll clamp to the casket lid, the roll clamp including an anchor portion and at least one angularly extending stop member, such that the anchor portion is directly secured to the casket lid;

b) securing a first elongated edge of a first roll to the casket lid proximate the periphery of the casket lid;

c) securing a second elongated edge of a first roll to the casket lid using a trap fit formed by the stop member and a portion of the first roll proximate the second elongated edge, wherein the second elongated edge is spaced apart from the first elongated edge by a roll surface; and d) after the second elongated edge of the first roll is secured to the casket lid, securing a center panel within the casket lid.

12. The method of claim 11 wherein step a) further comprises securing the anchor portion of the roll clamp to the casket lid using a fastening means.

13. The method of claim 11 wherein step a) further comprises securing a first roll clamp to the casket lid wherein the anchor portion and the at least one angularly extending stop member are integrally formed.

14. The method of claim 11 wherein step d) further comprises securing the center panel within the casket lid such that the at least a portion of the roll clamp is interposed between the casket lid and the center panel.

15. The method of claim 11 wherein step d) further comprises securing the center panel within the casket lid such that the center panel engages the roll clamp.

16. The method of claim 11 wherein step d) further comprises securing the center panel within the casket lid such that the center panel engages a center panel engagement surface that angularly extends from the stop member of the roll clamp.

17. The method of claim 11 wherein step c) further comprises securing the second elongated edge of the first roll to the casket lid in part using a fastening means.

18. The method of claim 11 wherein the casket lid includes an overhang and step b) further comprises securing the first elongated edge of the first roll to the casket lid proximate the periphery of the casket lid using a trap fit formed by the overhang.

19. The method of claim 11 wherein the anchor portion includes an elongated surface, and step a) further comprises forming a trap fit with the overhang and the elongated surface to secure the first roll clamp to the casket lid.

* * * * *